US006186348B1

(12) United States Patent
Rouët

(10) Patent No.: US 6,186,348 B1
(45) Date of Patent: Feb. 13, 2001

(54) BOTTLE HAVING THE OUTER ASPECT OF A FABRIC

(75) Inventor: Sophie Rouët, Paris (FR)

(73) Assignee: Escada Beaute, Paris (FR)

( * ) Notice: Under 35 U.S.C. 154(b), the term of this patent shall be extended for 0 days.

(21) Appl. No.: 09/088,071

(22) Filed: Jun. 1, 1998

(51) Int. Cl.[7] ..... B65D 23/08
(52) U.S. Cl. ..... 215/12.1; 215/10
(58) Field of Search ..... 215/12.1, 12.2, 215/13.1

(56) References Cited

U.S. PATENT DOCUMENTS

| | | | | |
|---|---|---|---|---|
| 995,700 | * | 6/1911 | Maynard | 215/12.1 |
| 1,468,808 | * | 9/1923 | Hamilton | 215/12.1 |
| 1,790,299 | * | 1/1931 | Foreman | 215/12.1 |
| 2,090,320 | * | 8/1937 | Amick | 215/12.1 |
| 2,328,338 | * | 8/1943 | Hauptman | 215/12.1 |
| 2,484,766 | * | 10/1949 | Zent et al. | 215/12.1 X |
| 3,006,780 | * | 10/1961 | Shaffer | 215/12.2 X |
| 3,080,989 | * | 3/1963 | Ramsbotham | 215/12.1 |
| 3,102,650 | * | 9/1963 | Seaver | 215/12.1 |
| 3,820,677 | * | 6/1974 | Garcia | 215/12.2 |
| 4,892,206 | * | 1/1990 | Perrin | 215/12.1 |
| 5,108,805 | * | 4/1992 | Gerard | 215/12.2 X |
| 5,125,521 | * | 6/1992 | Somogyi | 215/12.1 |

FOREIGN PATENT DOCUMENTS

| | | | | |
|---|---|---|---|---|
| 389953 | * | 9/1908 | (FR) | 215/12.1 |
| 522180 | * | 7/1921 | (FR) | 215/12.1 |
| 1054716 | * | 2/1954 | (FR) | 215/13.1 |
| 2402592 | * | 5/1979 | (FR) | 215/12.1 |
| 2620913 | * | 3/1989 | (FR) | 215/10 |
| 1670 | * | of 1883 | (GB) | 215/12.1 |
| 2066765 | * | 7/1981 | (GB) | 215/12.1 |
| 144581 | * | 9/1989 | (JP) | 215/12.1 |

* cited by examiner

*Primary Examiner*—Sue A. Weaver
(74) *Attorney, Agent, or Firm*—Young & Thompson

(57) ABSTRACT

A bottle includes an inner vessel for sealingly containing a liquid such as perfume or beverage, two externally flock-coated shell elements cemented to the inner vessel, a joint cover for covering a joint line between both shell elements, and a collar for aesthetically covering the upper regions of the shell-elements and the joint cover ends.

41 Claims, 3 Drawing Sheets

BOTTLE HAVING THE OUTER ASPECT OF A FABRIC

FIELD OF THE INVENTION

This invention relates to a bottle.

This invention more particularly relates to bottles intended to be part of luxury articles. The bottle is more particularly intended to contain a perfume or like liquid, but could also be adapted to contain liquors, spirits and other high value beverages and liquids.

OBJECTS OF THE INVENTION

One object of this invention is to provide the bottle with a pleasant, luxurious aspect while being at the same time of an economically realistic cost.

Another object of this invention is to provide a bottle which seems to be made of a fabric or to be coated with a fabric.

SUMMARY OF THE INVENTION

According to the invention, there is provided a bottle comprising:

an inner vessel, a shell covering an outer face of said inner vessel, wherein an outer face of said shell is provided with fibers adhered thereto, preferably in the form of a flock coating.

The flock coating is per se a well-known technology consisting in adhering fibres on a surface of an element and especially of a sheet.

The fibers adhered to the shell of the bottle according to the invention gives a strong impression that the bottle is covered with a fabric. The shell coated with fibers obviates most of the problems which would occur if the inner vessel had to be wrapped with an actual fabric. In particular, there is no problem of cutting a piece of fabric having a complicated shape, securing the piece of fabric onto the inner vessel, avoiding undesired folds. With the invention, the result can be excellent even if the shape of the bottle is complicated, irregular, with concave portions, etc.

Preferably, the shell is made of at least two shell elements.

A joint line between said shell elements can be advantageously covered by a joint cover such as a flat cord.

Preferably, the fibers-coated outer face is coloured. The colour can be uniform, or can be a composition of colours providing a design.

The colours referred to herein encompass black and white colours and more generally any colour which is used to change the natural colour of the shell and/or of the fibres which are adhered thereon. The design can consist of a message, e.g., a trademark, indication of the name of the product, etc.

Other features and advantages of this invention will emerge from the following description, which relates to non-limiting exemplary embodiments.

DESCRIPTION OF A PREFERRED EMBODIMENT

Figure 1:
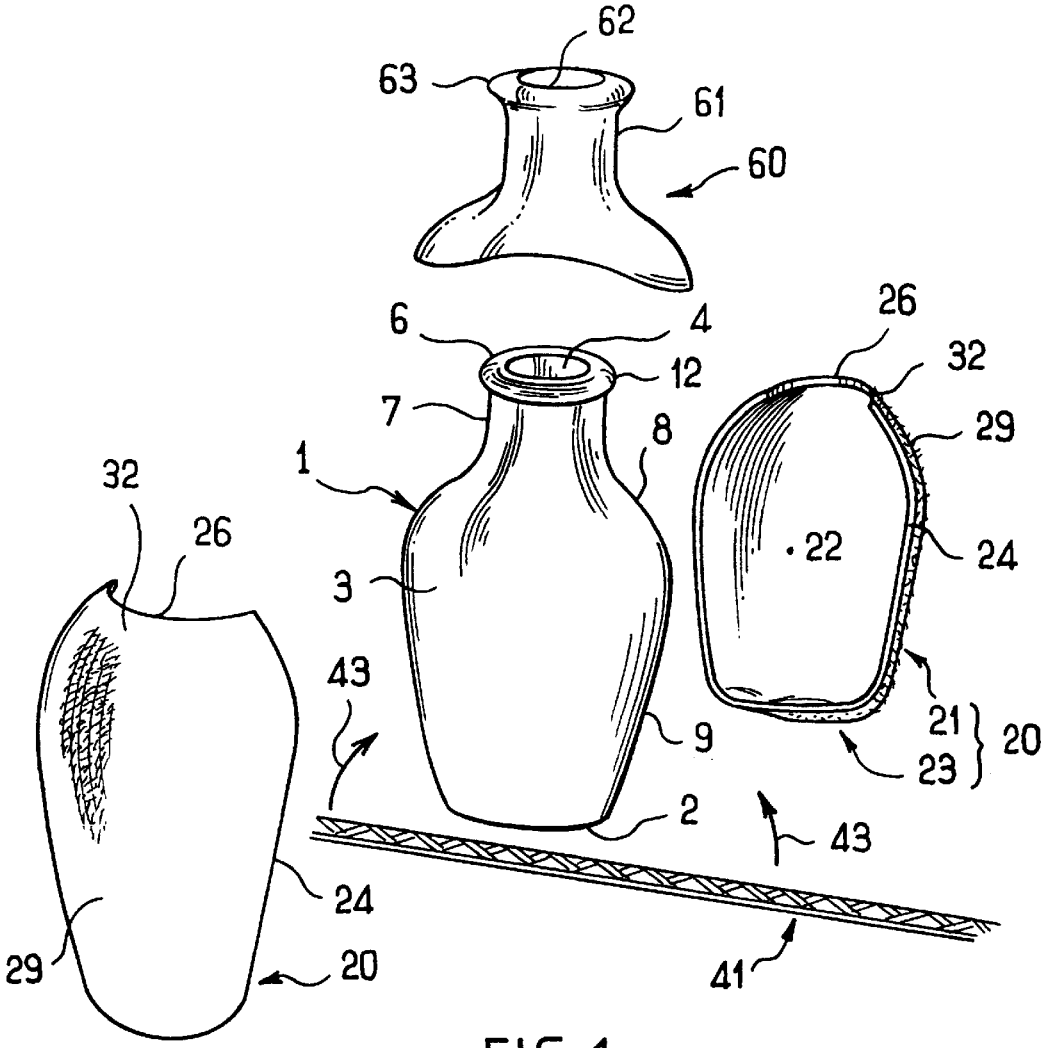
FIG. 1 is an exploded perspective view of a bottle according to the invention.

As shown in FIG. 1, the bottle comprises an inner vessel 1 which is for example made of glass. The inner vessel 1 will perform the functions of sealingly containing the liquid and of mechanically supporting the liquid therein as well as supporting other components which are still to be described outside the inner vessel 1.

The inner vessel 1 is especially provided with a bottom wall 2 and a side wall 3 extending therefrom. An opening 4 is defined by the upper edge 6 of the side wall 3. The upper edge 6 is provided at the top of a neck portion 7 of the side wall 3, which follows a shoulder portion 8 of the side wall 3. A body portion 9 of the side wall 3 extends between shoulder portion 8 and bottom wall 2.

The bottle furthermore comprises two half-shells 20 which are essentially made of thermoformable plastic material such as for example polystyrene or PVC. Each half-shell has a substantially uniform thickness and is provided with a side-wall 21 and a bottom wall 23. An inner face 22 of side-wall 21 matches the shape of a corresponding part of the outer face of the shoulder portion 8 and body portion 9 of side-wall 3 of the inner vessel 1. Bottom wall 23 is adapted to cover half of the bottom wall 2 of the inner vessel 1.

Both half-shells 20 are adapted to fit together over either side of the inner vessel 1 so as to cover substantially the entire shoulder portion 8 and body portion 9 of side wall 3 as well as bottom wall 2 of the inner vessel 1. The half-shells 20 join each other along a peripheral joint edge 24 which is continuous apart from an upper notch 26 provided on each half-shell 20 for allowing the neck portion 7 of inner vessel 1 to extend therethrough.

When the half-shells 20 are both fitted onto the inner vessel 1, they form together a joint line 27 which extends along a median plane 28 of the bottle from one side of shoulder portion 8 to an opposite side of shoulder portion 8 across the bottom of the bottle. In the example, the bottle and especially the body portion thereof has an ovoid horizontal cross-sectional shape (FIG. 4) and said median plane 28 is the longitudinal vertical median plane of the bottle. As more specifically shown in FIG. 4, the dimensions of the half-shells are so calculated that each half-shell snugly fits against the outer face of the inner vessel 1 whereas a small clearance exists between both half-shells 20 along the joint line 27. Assembly of the half-shells can be performed by cementing each half-shell against the outer face of the inner vessel 1.

Figure 4:
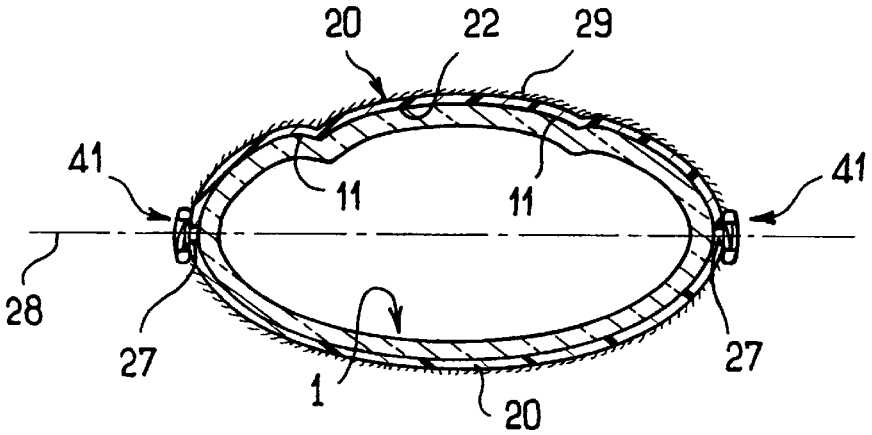
FIG. 4 is a cross-section along IV—IV of FIG. 2.

FIG. 4 also illustrates that the inner vessel 1 can have a relatively complicated shape with concave portions 11 on its outer face, the half-shells having a correspondingly complicated shape.

The outer face 29 of each half-shell 20 is wholly covered with a flock coating giving to each half-shell 20 the appearance of being made of a fabric. Depending on the type of flock-coating, the appearance of a thinner or coarser fabric can be given. Flock coating is a known technique by which each fibre is adhered by one end thereof to the supporting surface, here the outer surface of the half-shells 20, the remaining part of each fiber being free from the shell, whereby a velvet appearance is obtained.

The joint line 27 is covered by a joint cover 41 which extends all along the joint line 27 and has two end portions 42 (FIGS. 2 and 5) which are adjacent to the shoulder portion 8 or the neck portion 7 of the inner vessel 1. The joint cover 41 is wider than any expected slit between both shells 20 along the joint line 27. The exact texture and configuration of the joint cover 41 will be selected for esthetic purposes. Preferably the joint cover 41 is a flexible tape, e.g. a flat cord which is bent to follow the joint line 27, as illustrated by arrows 43 in FIG. 1. The joint cover 41 is secured in place by being cemented onto the half-shells 20.

Figure 3:
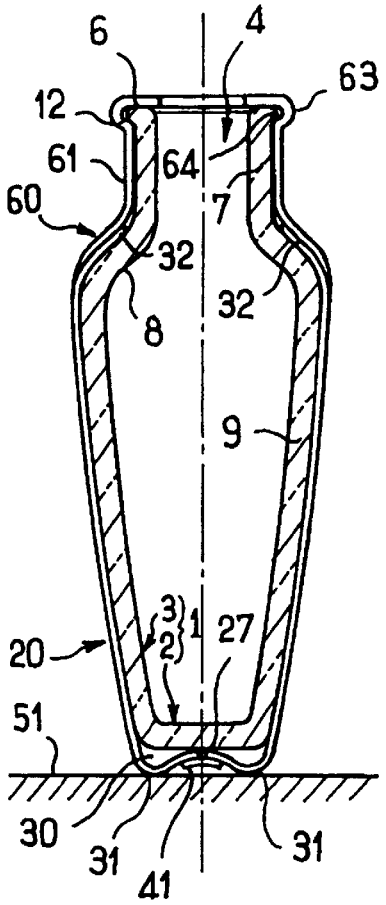
FIG. 3 is a cross-section of the bottle along a transverse vertical plane thereof.

As illustrated in FIG. 3, the shell which is composed of both half-shells 20 has a bulge 31 on either side of the portion of joint line 27 which extends across the bottom of the bottle. Thus, each half-shell 20 is provided with a respective one of the bulges 31. The bulges 31 form between them a recess which is sufficiently deep for accommodating the joint cover 41 which is salient therein. When the bottle stands on a flat horizontal surface 51, both bulges 31 which are elongated parallel to joint line 27 are the sole part of the bottle being in contact with surface 51 and provide a stable rest to the bottle.

There is between each bulge 31 and the outer face of the bottom 2 of the inner vessel 1 some space 38 left therebetween, while each half-shell 20 is in contact with said outer face of the bottom 2 adjacent the joint line 27. Each half-shell 20 is accurately positioned onto the inner vessel 1 by its contact with the bottom 2 of inner vessel 1 and with the shoulder portion 8 of inner vessel 1. In other words no significant movement or off-setting is possible along the vertical axis of the bottle between each half-shell 20 and the inner vessel 1.

The bottle further comprises a collar 60 which is adapted to be fitted around the neck portion 7 of the inner vessel 1, and over the two end portions 42 of the joint cover 41 as well as over an upper region 32 of each half-shell 20. The upper region 32 extends adjacent and around the notch 26.

Figure 2:
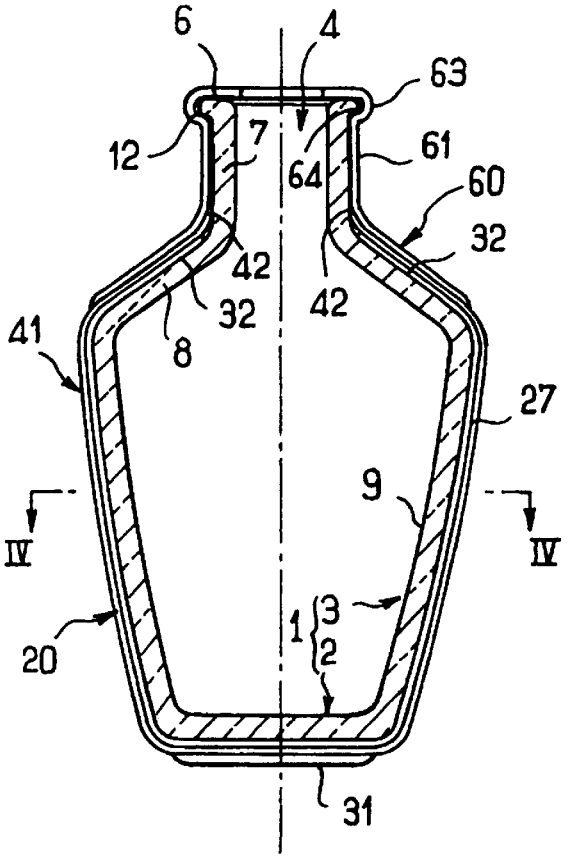
FIG. 2 is a cross-section of the bottle along a longitudinal vertical plane thereof.
Figure 5:
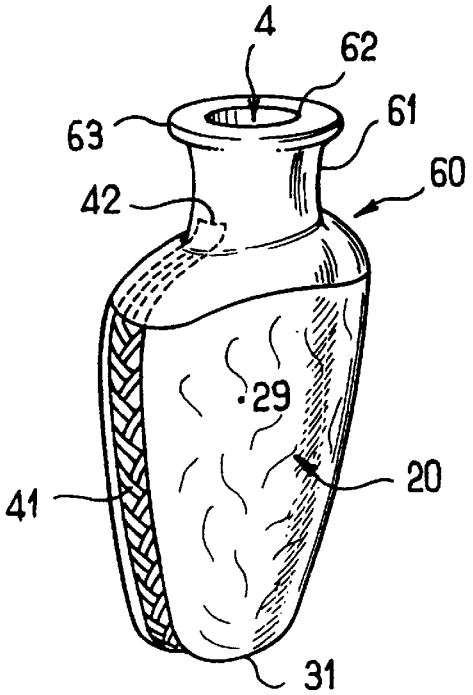
FIG. 5 is a perspective view of the bottle.
Figure 6:
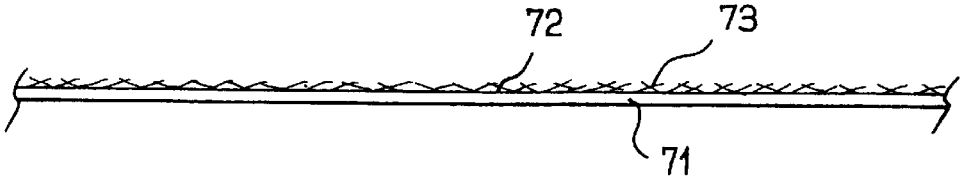
FIG. 6 illustrates the flock-coating step.

Thus, as apparent in FIGS. 2, 3 and 5, the collar 60, once mounted onto the bottle, conceals the upper portions of the joint cover 41 and of the half-shells 20. The collar 60 possesses a neck portion 61 which surrounds the entire external face of the neck portion 7 and the upper edge 6 of the inner vessel 1, whereby inner vessel 1 is completely hidden to the user once the bottle is completely mounted (FIG. 5). The collar 60 has an upper orifice 62 which is adapted to match opening 4 of the inner vessel 1. The collar 60 also has an annular bulge 63 which protrudes radially outwardly around orifice 62 and defines an inner annular groove 64 (FIGS. 2 and 3) of the collar 60. The collar 60 is mounted onto the inner vessel 1 by a movement directed vertically and downwardly with respect to the inner vessel 1 assumed to be in its normal standing position, until the annular groove 64 enters into a snap-fit relationship with an annular bulge 12 provided on inner vessel 1 around the opening 4. The collar 60 is furthermore cemented to the underlying elements of the bottle. To this end, cement is spread on the collar inner face prior to its above-described mounting onto the inner vessel 1. Cement is especially applied along the lower edge of the collar, between the collar and the upper region of the half-shells and between the collar and the upper edge of the joint cover 40. The collar can be made e.g. of metal, glass, plastic, metal-plated plastic, or can be a further flock-coated shell portion of the invention.

The method of making a shell element such as 20 comprises:

providing a flat planar sheet of polystyrene or PVC 71 and flock coating one face 72 of the sheet 71 so as to adhere fibres 73 to said face. The sheet 71 is preferably a continuous web.

Figure 7:
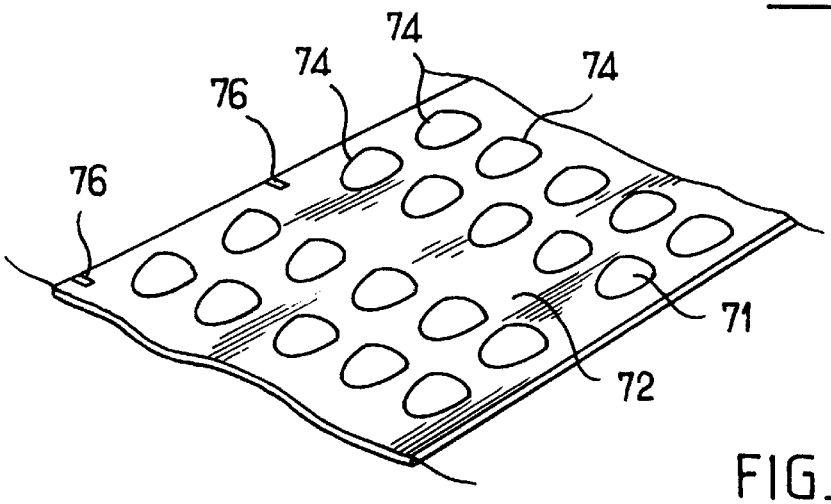
FIG. 7 illustrates the step of providing a colour design for the flock-coated side of the sheet.

As shown in FIG. 7, a coloured pattern is repetitively applied to the face 72 of the sheet 71.

The pattern is a group of e.g. ten individual patterns 74. Each individual pattern 74 is intended to belong to a half-shell which will be manufactured. In FIG. 7 two identical patterns of ten individual patterns are illustrated. Each pattern furthermore comprises a positioning mark 76.

It should be noted that methods of printing a colour pattern or more generally of colouring a flock coated sheet are known and are not per se the subject matter of this invention. Some methods comprise colouring sheet 71 and only thereafter flock-coating the same, whereas other methods provide flock-coating first and colouring thereafter. The second one is presently preferred.

Figure 8:
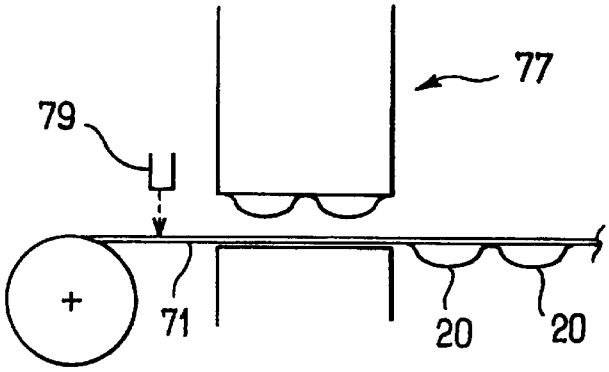
FIG. 8 illustrates the thermoforming step.
Figure 9:
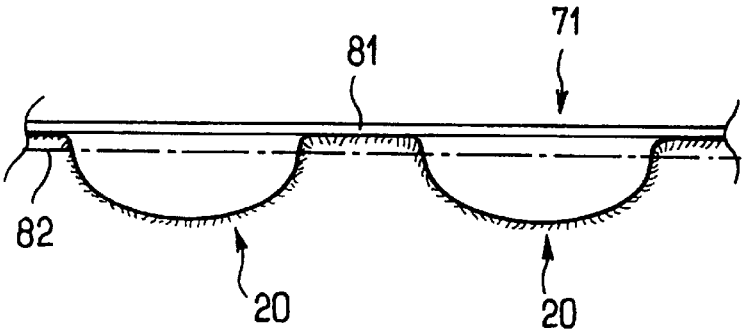
FIG. 9 illustrates the step of cutting individual shell elements.

The web is then displaced through a thermoforming machine 77 (FIG. 8). An optical detector 79 is placed in line with the machine and controls a stop of the advance of the web 71 each time a mark 76 is detected. Then, the machine 77 forms ten shell elements 20 which coincide with the individual patterns 74. Thermoforming per se is a known technique and will not be described in detail.

The thermoforming step leaves portions 81 of sheet 71 in an undeformed condition between the individual shell elements 20. Each shell element 20 is separated from sheet 71 and especially from the planar portions 81 thanks to a cutting step along a plane 82 which is parallel to the undeformed portions 81 and at some distance thereof, on the side thereof towards which the shell elements are formed.

Of course, this invention is not limited to the exemplary embodiments which have been described. Depending on the shape of the bottle, a single shell could be enough, for example a frustoconical shell flaring out upwardly, or a cylindrical or substantially cylindrical shell for a bottle of the Bordeaux-wine shape. On the contrary, there could be more than two shell elements, for example with a bottle having multiple lobes as seen from above.

The collar could be replaced by another covering means such as a ribbon.

Instead of adhering the fibers only by one end thereof onto the shell, as is permitted by the flock coating technique, it could be possible to adhere the whole length of the fibers onto the shell, thereby to obtain a different aesthetic effect. Nevertheless, flock coating is presently preferred.

What is claimed is:

1. A bottle comprising:

an inner vessel for leak-tight retention of liquid, a shell permanently secured to said inner vessel and covering an outer face of said inner vessel, wherein an outer face of said shell is provided with fibres having one end adhered to the shell and a remaining portion which is free from the shell.

2. A bottle according to claim 1, wherein the fibres are randomly adhered to the shell.

3. A bottle according to claim 1, wherein the fibres are a flock-coating.

4. A bottle according to claim 1, wherein said shell is made of plastic.

5. A bottle according to claim 1, wherein said inner vessel is made of glass.

6. A bottle according to claim 1, wherein said outer face provided with fibers is coloured.

7. A bottle according to claim 1, wherein said outer face provided with fibers has a printed pattern thereon.

8. A bottle according to claim 1, wherein the shell comprises at least two complementary shell-elements.

9. A bottle according to claim 8, wherein said shell-elements are thermoformed.

10. A bottle according to claim 8, wherein said shell elements are supported by said inner vessel.

11. A bottle according to claim 8, wherein said shell-elements are adjacent to each other along a joint line, and wherein said joint-line is covered by a joint cover.

12. A bottle according to claim 11, wherein said joint cover is a cemented tape.

13. A bottle according to claim 11, wherein said bottle has a shoulder portion and a bottom face, and said joint line extends from one side of said shoulder portion to an opposite side of said shoulder portion, across said bottom face.

14. A bottle according to claim 11, wherein said joint line extends across a bottom face of said bottle, and wherein said shell-elements are formed with a bottle-supporting bulge on said bottom face on either side of said joint line.

15. A bottle according to claim 14, wherein said joint cover is salient with respect to said outer face of said shell.

16. A bottle according to claim 13, wherein said inner vessel has a neck surrounded by said shoulder portion, and said bottle comprises a collar which is secured on said shoulder portion around said neck thereby to partially cover said shell-elements and said joint cover.

17. A bottle according to claim 1, being a perfume bottle.

18. A bottle according to claim 1, comprising a collar covering a neck portion of said inner vessel and an upper portion of said shell.

19. A bottle according to claim 18, wherein said collar is snap-fitted onto said inner vessel and cemented onto said shell.

20. A bottle according to claim 1, wherein said shell is supported by said inner vessel.

21. A bottle comprising:

an inner vessel;

a shell covering an outer face of said inner vessel, wherein an outer face of said shell is provided with fibres adhered thereto, and wherein said outer face provided with fibres has a printed pattern thereon.

22. A bottle according to claim 21, wherein the fibres are randomly adhered to the shell.

23. A bottle according to claim 21, wherein the fibres are a flock-coating.

24. A bottle according to claim 21, wherein said shell is made of plastic.

25. A bottle according to claim 21, wherein the shell comprises at least two complementary shell-elements.

26. A bottle according to claim 25, wherein said shell-elements are thermoformed.

27. A bottle according to claim 25, wherein said shell elements are adjacent to each other along a joint line, and wherein said joint-line is covered by a joint cover.

28. A bottle according to claim 27, wherein said joint line extends across a bottom face of said bottle, and wherein said shell-elements are formed with a bottle-supporting bulge on said bottom face on either side of said joint line.

29. A bottle according to claim 27, wherein said bottle further comprises a collar which is secured around a neck of the bottle partially covering an upper region of said shell-elements and two ends of said joint cover.

30. A bottle according to claim 21, being a perfume bottle.

31. A bottle according to claim 21 comprising a collar covering a neck portion of said inner vessel and an upper portion of said shell.

32. A bottle according to claim 31, wherein said collar is snap-fitted onto said inner vessel and cemented onto said shell.

33. A bottle according to claim 21, wherein the fibers have one end adhered to the shell and a remaining portion which is free from the shell.

34. A bottle comprising:

an inner vessel, a shell covering an outer face of said inner vessel, a collar covering a neck portion of said inner vessel and an upper portion of said shell, wherein an outer face of said shell is provided with fibers adhered thereto, and wherein said collar is snap-fitted onto said inner vessel and cemented onto said shell.

35. A bottle according to claim 34, wherein the fibres are a flock-coating.

36. A bottle according to claim 34, wherein said shell is made of plastic.

37. A bottle according to claim 34, wherein said inner vessel is made of glass.

38. A bottle according to claim 34, wherein said collar has an annular bulge which protrudes radially outwardly and defines an inner annular groove which is in a snap-fit relationship with an annular bulge provided on said inner vessel around said neck.

39. A bottle according to claim 34, wherein the shell comprises at least two complementary shell-elements which are adjacent to each other along a joint line, and wherein said joint-line is covered by a joint cover having two ends covered by said collar.

40. A bottle according to claim 39, wherein said joint cover is a cemented tape.

41. A bottle according to claim 34, being a perfume bottle.

* * * * *